US011416018B1

(12) United States Patent
Hutchings

(10) Patent No.: US 11,416,018 B1
(45) Date of Patent: Aug. 16, 2022

(54) SPRING MEMBERS

(71) Applicant: Hewlett-Packard Development Company, L.P., Spring, TX (US)

(72) Inventor: Cameron Hutchings, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/388,357

(22) Filed: Jul. 29, 2021

(51) Int. Cl.

| | |
|---|---|
| ***G05G 1/10*** | (2006.01) |
| ***B41J 29/13*** | (2006.01) |
| ***G05G 5/03*** | (2008.04) |

(52) U.S. Cl.
CPC ..... *G05G 1/10* (2013.01); *B41J 29/13* (2013.01); *G05G 5/03* (2013.01); *G05G 2505/00* (2013.01)

(58) Field of Classification Search
CPC ..... G05G 2505/00
See application file for complete search history.

(56) References Cited

U.S. PATENT DOCUMENTS

2018/0358195 A1* 12/2018 Deng et al. ..... G05G 5/02

* cited by examiner

*Primary Examiner* — Vicky A Johnson
(74) *Attorney, Agent, or Firm* — Brooks Cameron & Huebsch PLLC

(57) ABSTRACT

In some examples, an apparatus can include a dial having a central axis and an inner channel defined by a first surface and a second surface, and a middle cover having a central axis, where the middle cover includes a first spring member and a second spring member, the first spring member and the second spring member are biased away from the central axis, and where when the dial is interfaced with the middle cover, the first spring member and the second spring member are to interface with the first surface and the second surface of the dial.

12 Claims, 8 Drawing Sheets

SPRING MEMBERS

BACKGROUND

Imaging/printing systems, such as printers, copiers, etc., may be used to form markings on a physical medium, such as text, images, etc. In some examples, imaging systems may form markings on the physical medium by performing a print job. A print job can include forming markings such as text and/or images by transferring a print material (e.g., ink, toner, etc.) to the physical medium.

DETAILED DESCRIPTION

Figure 1:
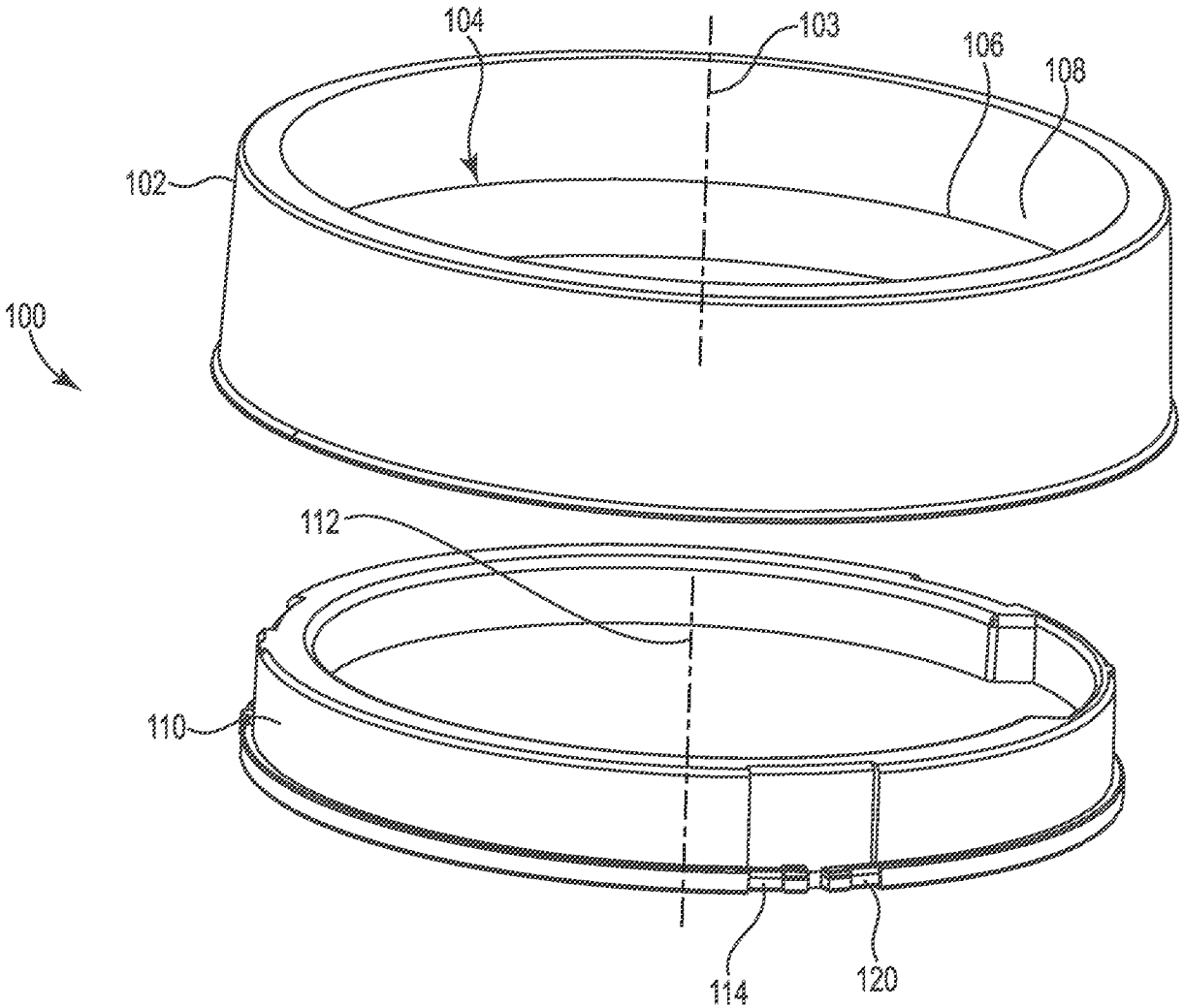
FIG. 1 is an exploded perspective view of an example of an apparatus including a dial and a middle cover consistent with the disclosure.

Imaging/printing devices may include a supply of a print material. As used herein, the term "print material" refers to a substance which can be transported through and/or utilized by an imaging device. In some examples, print material can be, for instance, a material that when applied to a medium, can form representation(s) (e.g., text, images, models, etc.) on the medium during a print job. Print material may include ink, toner, polymers, metals, colorants, etc.

The print material can be deposited onto a physical medium. As used herein, the term "printing device" refers to any hardware device with functionalities to physically produce representation(s) (e.g., text, images, models, etc.) on the medium. In some examples, a "medium" may include paper, photopolymers, plastics, composite, metal, wood, fabric, or the like. A printing device can further include other functionalities such as scanning, faxing, and/or other printing device functionalities, and can perform print jobs when in receipt of a print job request from a computing device or other network (e.g., Internet) connected device.

User inputs to a printing device may be made through various input mechanisms. For example, input mechanisms for a printing device may include utilizing buttons on the printing device, a touch screen display on the printing device, transmitting wireless signals to the printing device, among other types of input mechanisms.

In some examples, a dial control panel can be utilized as an input mechanism for a printing device. A dial control panel can include, for instance, a wheel that can be rotated (e.g., by a user) to navigate menus, select printing functions, etc. Such menus, printing functions, and other information may be displayed on a display that can be included on the printing device, integrated within the dial control panel, etc. The dial control panel can be depressed by a user in order to make a menu selection, select a print function, etc. In some examples, the user may make a selection by interacting with the display, which may be a touch screen display.

The dial control panel can allow for a more streamlined and efficient input mechanism relative to previous approaches. For example, a dial control panel may allow a user to more quickly navigate different printing device functions, input information such as number of copies (e.g., for a print job), email addresses, shared folders, usernames/passwords, etc., as compared with previous approaches.

In some instances, certain dial control panel designs may result in a poor user experience with the printing device. For example, a dial control panel that jitters (e.g., wobbles) when rotated may cause a user to dislike the printing device, as the user may think the build quality of the printing device is low. As a result, the printing device may not be as desirable to consumers.

Spring members according to the disclosure can allow for a solid, smooth spinning dial control panel without horizontal or vertical wobble when rotated, as is further described herein. Such a dial control panel can ensure a positive user experience for a user, and as a result, be a desirable product to consumers.

FIG. 1 is an exploded perspective view of an example of an apparatus 100 including a dial 102 and a middle cover 110 consistent with the disclosure. The dial 102 can include a central axis 103 and the middle cover 110 can include a central axis 112.

As illustrated in FIG. 1, the apparatus 100 can include a dial 102. As used herein, the term "dial" refers to a rotatable knob. The dial 102 can be rotatable about the central axis 103 of the dial 102. For example, the dial 102 can be a portion of the dial control panel such that a user may utilize the dial 102 by rotating the dial 102 in order to navigate menus, select printing functions, etc. Such menus and other printing functions may be displayed via a display (e.g., not illustrated in FIG. 1), connected to the middle cover 110 via other sub-assemblies (e.g., not illustrated in FIG. 1). The dial 102 may be rotated relative to the middle cover 110. That is, the dial 102 can rotate about the central axis 103 while the middle cover 110 is stationary and connected to an outer cover of a printing device, as is further described in connection with FIG. 5. A user may rotate the dial 102 by gripping the "outer" side of the dial 102 (e.g., as oriented in FIG. 1) and rotating the dial 102 via the user's hand/fingers, in some examples.

The dial 102 can be a plastic material. However, examples of the disclosure are not so limited. For example, the dial 102 can be metal, carbon fiber, and/or any other type of material. Further, the dial 102 may be molded (e.g., by insert molding, injection molding, overmolding, or other molding techniques), three-dimensional (3D) printed, machined, or manufactured via any other manufacturing technique.

The dial 102 can include an inner channel 104. As used herein, the term "channel" refers to an opening in a portion of material. For example, the inner channel 104 can be an opening in an "inner" side of the dial 102 (e.g., as oriented in FIG. 1).

The inner channel 104 can be defined by a first surface 106 and a second surface 108. For example, the inner channel 104 can be an "L" shaped channel defined by a first surface 106 that is located relative to a second surface 108 on the "inner" side of the dial 102, as is further described in connection with FIG. 3.

The apparatus 100 can further include the middle cover 110. As used herein, the term "cover" refers to an object which is located on, over, or around other object(s). For example, the middle cover 110 can be a portion of an assembly of a dial control panel and can be located on, over, and/or around other components of the printing device and/or the dial control panel. The middle cover 10 can include a central axis 112.

The middle cover 110 can be a plastic material. For example, the middle cover 110 can be an acrylonitrile butadiene styrene (ABS) plastic material with Teflon. However, examples of the disclosure are not so limited. For example, the middle cover 110 can be any other plastic material, can be metal, carbon fiber, etc. Further, the middle cover 110 may be molded (e.g., by insert molding, injection molding, overmolding, or other molding techniques), three-dimensional (3D) printed, machined, or manufactured via any other manufacturing technique.

As illustrated in FIG. 1, the middle cover 110 can include a first spring member 114 and a second spring member 120. As used herein, the term "spring member" refers to a constituent elastic part of a structural whole that stores mechanical energy. For example, the first spring member 114 and the second spring member 120 can store potential energy when in an engaged orientation, as is further described herein.

The first spring member 114 and the second spring member 120 can be biased away from the central axis 112. For example, when the first spring member 114 and the second spring member 120 are in a disengaged orientation (e.g., as illustrated in FIG. 1), the first spring member 114 and the second spring member 120 can be oriented in a direction away from the central axis 112. When the dial 102 is not interfaced with the middle cover 110 (e.g., as illustrated in FIG. 1), the first spring member 114 and the second spring member 120 can be in a disengaged orientation. As used herein, the term "disengaged orientation" refers to an orientation of the first spring member 114 and the second spring member 120 such that the first spring member 114 and the second spring member 120 are in a free-hanging state and not receiving a force.

When the dial 102 is interfaced with the middle cover 110, the first spring member 114 and the second spring member 120 are to interface with the first surface 106 and the second surface 108, respectively, of the dial 102. For example, the first spring member 114 can interface with the first surface 106 and the second spring member 120 can interface with the second surface 108. In such an orientation, the first spring member 114 and the second spring member 120 can be in an engaged orientation. As used herein, the term "engaged orientation" refers to an orientation of the first spring member 114 and the second spring member 120 such that the first spring member 114 and the second spring member 120 are experiencing a force. The force can be caused by the dial 102 and can cause the first spring member 114 and the second spring member 120 to be rotated towards the central axis 112 and provide a constant force on the first surface 106 and the second surface 108 of the channel 104 which can provide a smooth spinning dial 102, as is further described herein.

Although a single pair of spring members 114 and 120 are illustrated in FIG. 1, examples of the disclosure are not so limited. For example, the middle cover 110 can include more than one pair of spring members 114 and 120, as is further described in connection with FIG. 2B.

Figure 2A:
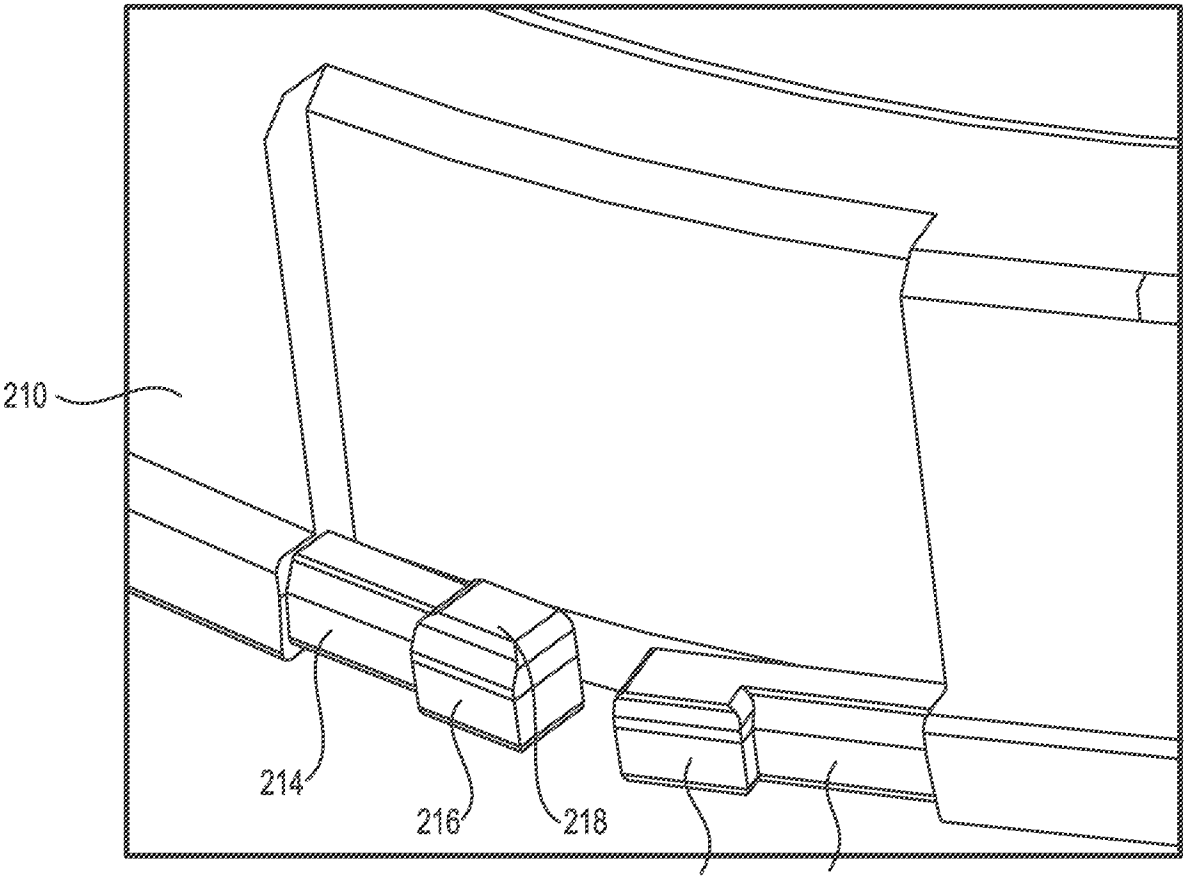
FIG. 2A is a perspective view of an example of a middle cover having spring members consistent with the disclosure.

FIG. 2A is a perspective view of an example of a middle cover 210 having spring members 214, 220 consistent with the disclosure. As illustrated in FIG. 2A, the middle cover 210 is not interfaced with a dial.

The first spring member 214 can include a first lateral protrusion 216. As used herein, the term "lateral protrusion" refers to a projection of material. The first lateral protrusion 216 can, accordingly, be a projection of material from the first spring member 214 in a same direction as the bias of the first spring member 214. That is, the first lateral protrusion 216 can be a projection of material from the first spring member 214 in a direction away from the central axis (e.g., not illustrated in FIG. 2A) of the middle cover 210. The first lateral protrusion 216 can interface with the first surface of the channel of the dial (e.g., previously described in connection with FIG. 1).

As illustrated in FIG. 2A, the first spring member 214 can additionally include a vertical protrusion 218. As used herein, the term "vertical protrusion" refers to a projection of material. The vertical protrusion 218 can, accordingly, be a projection of material from the first spring member 214 in a direction normal or substantially normal to the first lateral protrusion 216. That is, the vertical protrusion 218 can be a projection of material from the first spring member 214 in a substantially upwards direction (e.g., as oriented in FIG. 2A). The vertical protrusion 218 can interface with the second surface of the channel of the dial (e.g., previously described in connection with FIG. 1).

The second spring member 220 can include a second lateral protrusion 222. The second lateral protrusion 222 can, accordingly, be a projection of material from the second spring member 220 in a same direction as the bias of the second lateral protrusion 222. That is, the second lateral protrusion 222 can be a projection of material from the second spring member 220 in a direction away from the central axis (e.g., not illustrated in FIG. 2A) of the middle cover 210. The second lateral protrusion 222 can interface with the first surface of the channel of the dial (e.g., previously described in connection with FIG. 1).

Figure 2B:
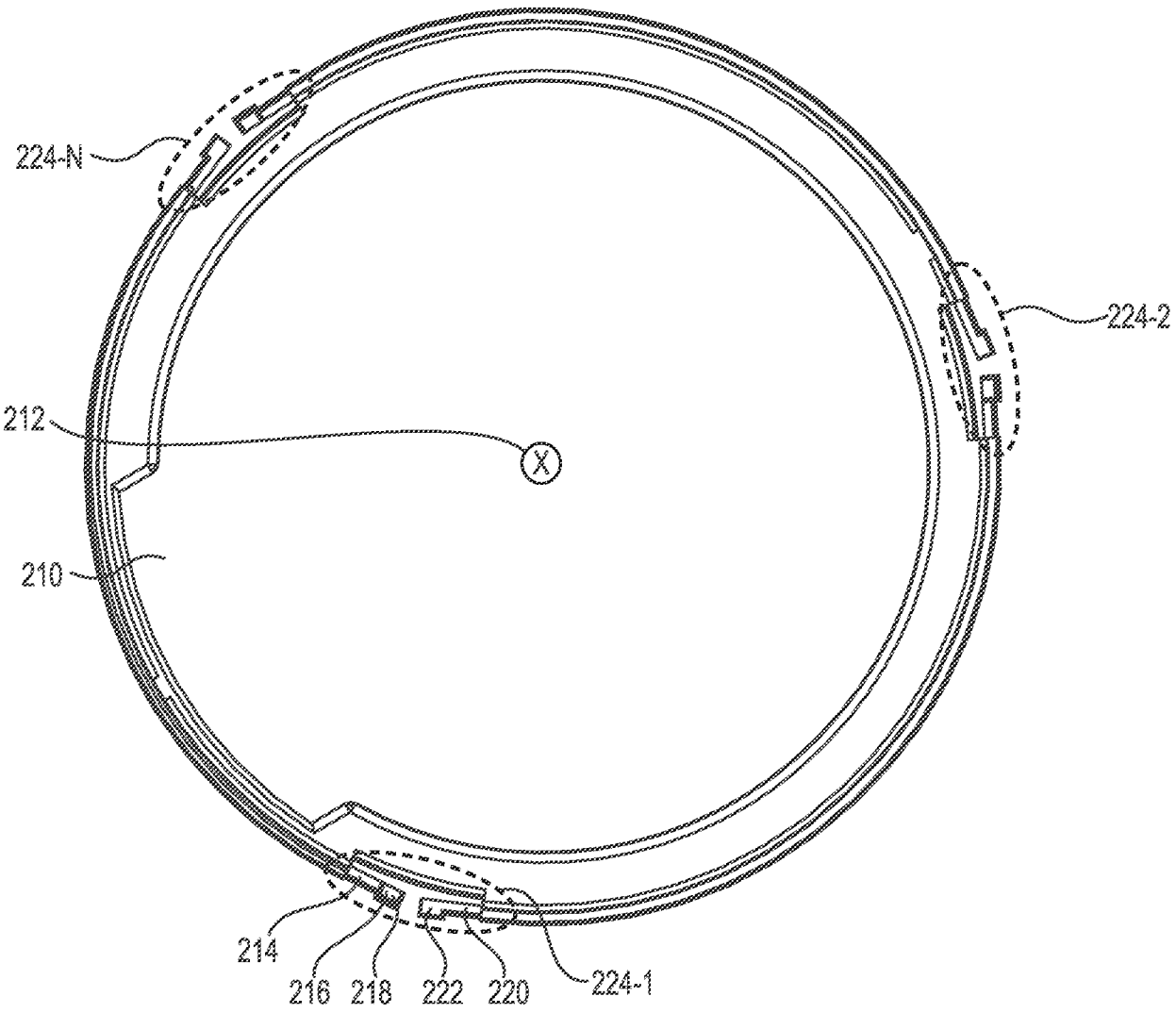
FIG. 2B is a top view of an example of a middle cover having spring members consistent with the disclosure.

FIG. 2B is a top view of an example of a middle cover 210 having spring members 214, 220 consistent with the disclosure. The middle cover 210 can include the central axis 212.

As illustrated in FIG. 2B, the middle cover 210 can include the first spring member 214 and the second spring member 220. The first spring member 214 can include a first lateral protrusion 216 and a vertical protrusion 218. The second spring member 220 can include a second lateral protrusion 222.

The first spring member 214 and the second spring member 220 can be a pair of spring members 224-1. As illustrated in FIG. 2B, the pair of spring members 224-1 can be included in a plurality of pairs of spring members 224-1, 224-2, 224-N (referred to collectively herein as pairs of spring members 224). For example, the middle cover 210 can include three pairs of spring members 224. However, examples of the disclosure are not so limited. For instance, the middle cover 210 can include less than three pairs of spring members 224 or more than three pairs of spring members 224.

The pairs of spring members 224 can be radially spaced apart from the central axis 212 of the middle cover 210. For example, the pairs of spring members 224 can be located radially outwards from the central axis 212 and around a perimeter of the middle cover 210.

Figure 3:
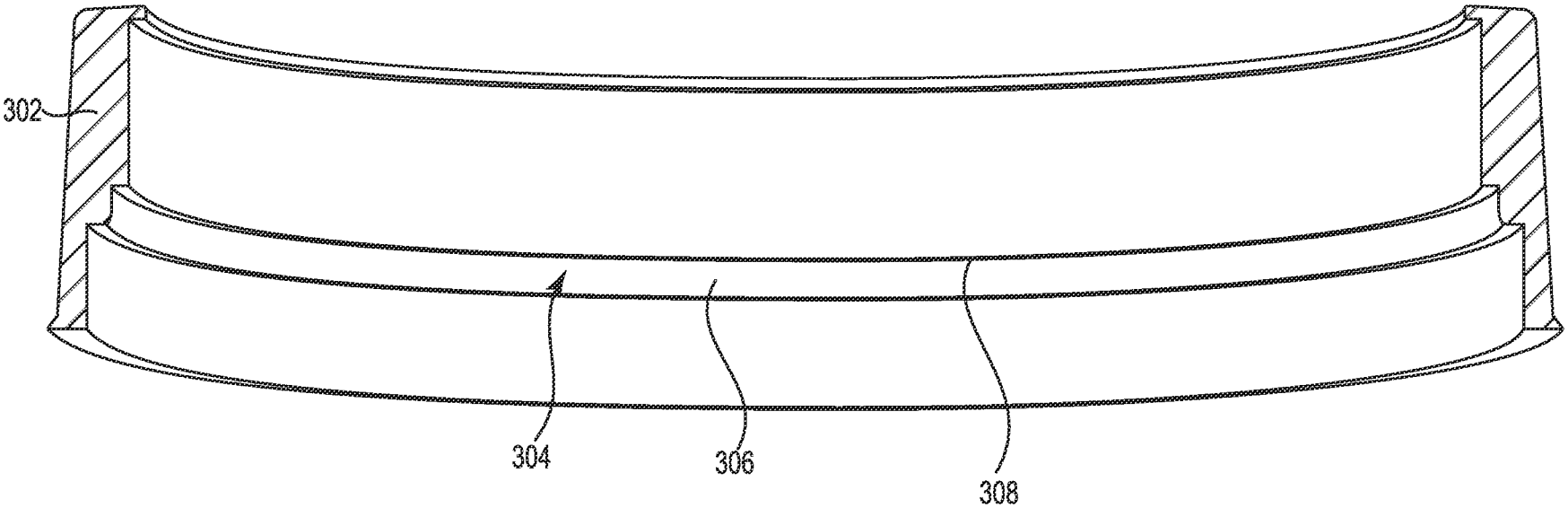
FIG. 3 is a perspective section view of an example of a dial having an inner channel consistent with the disclosure.

FIG. 3 is a perspective section view of an example of a dial 302 having an inner channel 304 consistent with the disclosure. The channel 304 can include a first surface 306 and a second surface 308.

As illustrated in FIG. 3, the channel 304 can include the first surface 306 and the second surface 308. The second surface 308 can be perpendicular (or substantially perpendicular) to the first surface 306. For example, the second surface 308 can be at a right angle or substantially right angle relative to the first surface 306.

The first surface 306 can be a polished surface. As used herein, the term "polished" refers to a smooth surface. For example, the polished surface of the first surface 306 can allow for smooth motion of the dial 302 when the first lateral protrusion of the first spring member and the second lateral protrusion of the second spring member are in contact with the first surface 306. The polished surface of the first surface 306 may be created during manufacturing of the dial 302 (e.g., during molding), or may be created after manufacturing of the dial 302 by polishing (e.g., via rubbing, application of a chemical treatment, etc. or combinations thereof).

Additionally, although not illustrated in FIG. 3, in some examples, the first surface 306 may include a race. The race may be, for example, a metal, plastic, or other smooth material that can allow for smooth motion of the dial 302 when the first lateral protrusion of the first spring member and the second lateral protrusion of the second spring member are in contact with the first surface 306.

Figure 4A:
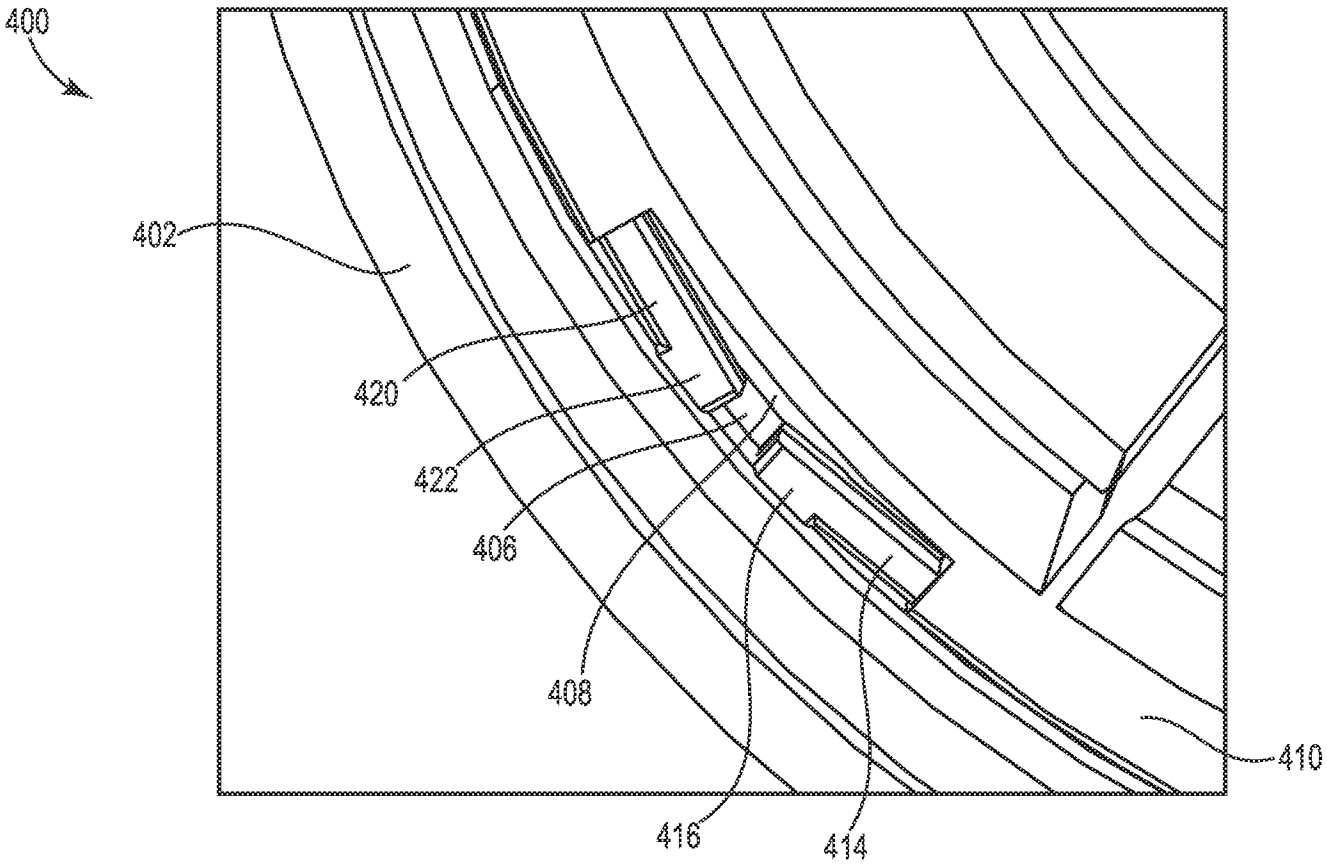
FIG. 4A is a bottom perspective view of an example of an apparatus including a dial and a middle cover consistent with the disclosure.

FIG. 4A is a bottom perspective view of an example of an apparatus 400 including a dial 402 and a middle cover 410 consistent with the disclosure. The dial 402 can include a first spring member 414 and a second spring member 420.

The dial 402 can include the first surface 406 and the second surface 408. The middle cover 410 can include the first spring member 414 and the second spring member 420.

The first spring member 414 can include the first lateral protrusion 416 and a vertical protrusion (e.g., not visible in the bottom perspective view of FIG. 4A. The second spring member 420 can include the second lateral protrusion 422.

As illustrated in FIG. 4A, the dial 402 can be interfaced with the middle cover 410. As a result, the first spring member 414 and the second spring member 420 are to interface with the first surface 406 and the second surface 408 of the dial 402. For example, the first lateral protrusion 416 and the second lateral protrusion 422 can be interfaced with the first surface 406 of the dial, and the vertical protrusion (e.g., not illustrated in FIG. 4A) can interface with the second surface 408 of the dial 402.

As previously described in connection with FIG. 1, the first spring member 414 and the second spring member 420 can be biased away from the central axis of the middle cover 410 and in a disengaged position when the middle cover 410 and the dial 402 are not interfaced. When the middle cover 410 and the dial 402 are interfaced as in FIG. 4A, the first spring member 414 and the second spring member 420 can be in an engaged orientation. That is, when the dial 402 is interfaced with the middle cover 410, the first surface 406 is to cause the first spring member 414 and the second spring member 420 to rotate towards the central axis of the middle cover 410. When the first spring member 414 and the second spring member 420 are in the engaged orientation, the first lateral protrusion 416 and the second lateral protrusion 422 can provide a constant force against the first surface 406 and the vertical protrusion of the first spring member 414 can provide a constant force against the second surface 408, as is further described in connection with FIG. 5.

Figure 4B:
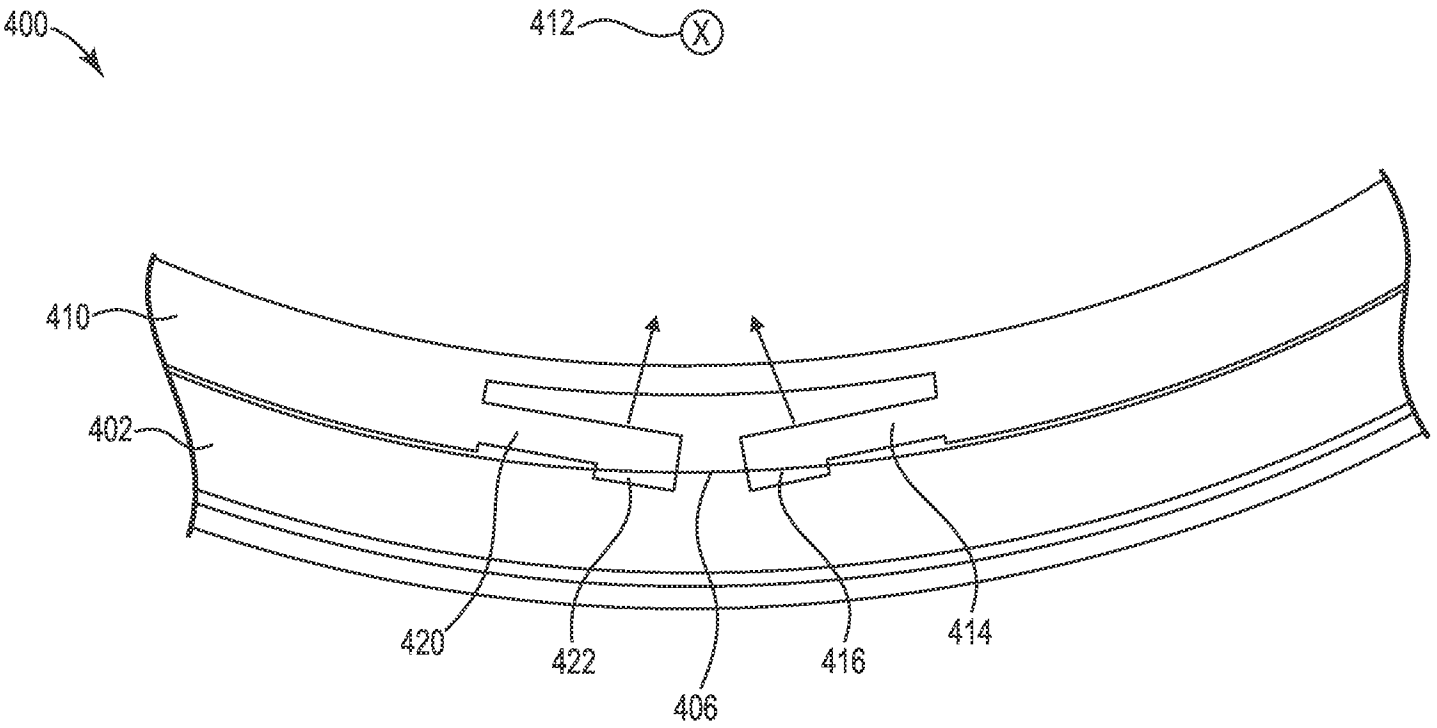
FIG. 4B is a bottom section view of an example of an apparatus including a dial and a middle cover consistent with the disclosure.

FIG. 4B is a bottom section view of an example of an apparatus 400 including a dial 402 and a middle cover 410 consistent with the disclosure. The dial 402 can include a first spring member 414 and a second spring member 420.

The first spring member 414 can include the first lateral protrusion 416 and a vertical protrusion (e.g., not visible in the bottom perspective view of FIG. 4A. The second spring member 420 can include the second lateral protrusion 422.

As previously described in connection with FIG. 4A, when the dial 402 is interfaced with the middle cover 410, the first surface 406 can cause the first spring member 414 and the second spring member 420 to rotate towards the central axis 412 of the middle cover 410 such that the first lateral protrusion 416 and the second lateral protrusion 422 provide a constant force against the first surface 406. Such a constant force against the first surface 406 can allow for a smooth spinning dial control panel when rotated, as is further described in connection with FIG. 5.

Figure 4C:
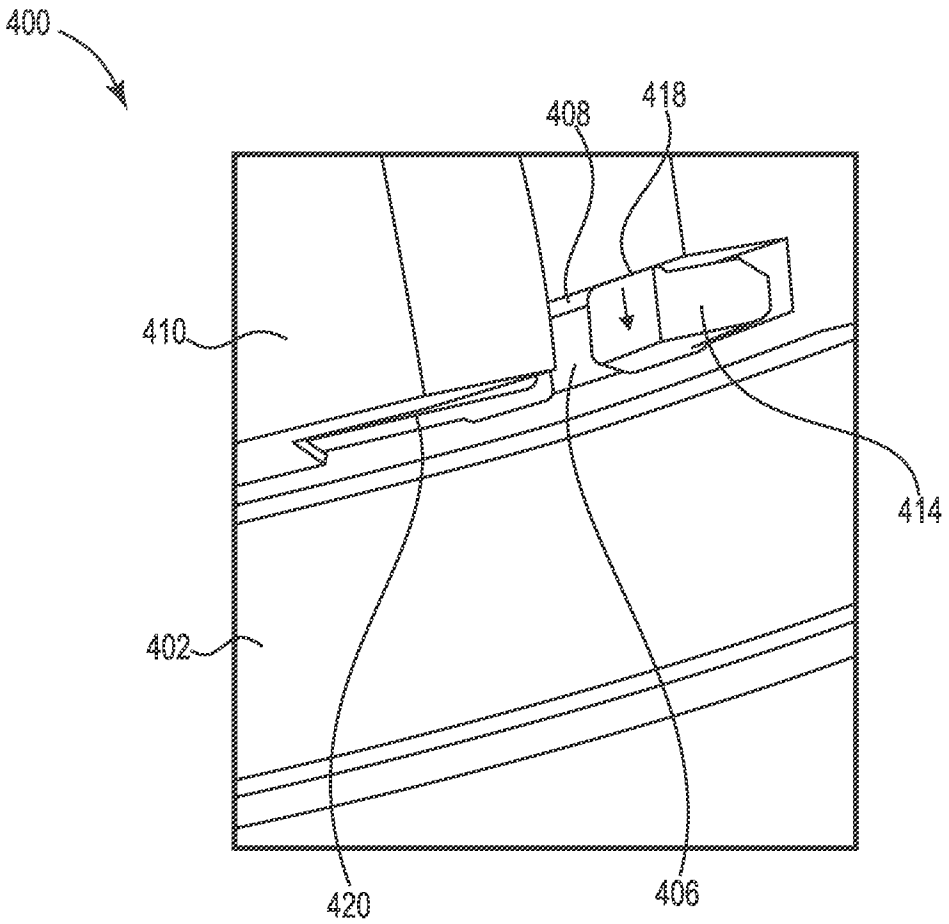
FIG. 4C is a side section perspective view of an example of an apparatus including a dial and a middle cover consistent with the disclosure.

FIG. 4C is a side section perspective view of an example of an apparatus including a dial and a middle cover consistent with the disclosure. The dial 402 can include a first spring member 414 and a second spring member 420.

The dial 402 can include the first surface 406 and the second surface 408. The middle cover 410 can include the first spring member 414 and the second spring member 420. Although not illustrated in FIG. 4C, the first spring member 414 can include a first lateral protrusion to interface with the first surface 406 and the second spring member 420 can include a second lateral protrusion to interface with the first surface 406, as previously described in connection with FIGS. 4A and 4B.

The first spring member 414 can include the vertical protrusion 418. When the middle cover 410 and the dial 402 are interfaced as in FIG. 4C, the first spring member 414 and the second spring member 420 can be in an engaged orientation such that the first spring member 414 can rotate towards the central axis of the middle cover 410 (e.g., not illustrated in FIG. 4C, but previously described in connection with FIGS. 4A and 4B), as well as rotate downwards (e.g., as illustrated in FIG. 4C) as a result of the vertical protrusion 418 interfacing with the second surface 408. When the first spring member 414 and the second spring member 420 are in the engaged orientation, the vertical protrusion 418 of the first spring member 414 can provide a constant force against the second surface 408.

While the first spring member 414 is illustrated in FIG. 4C and previously described herein as including a vertical protrusion 418 but the second spring member 420 does not include a vertical protrusion, examples of the disclosure are not so limited. For example, both the first spring member 414 and the second spring member 420 may include vertical protrusions.

Figure 5:
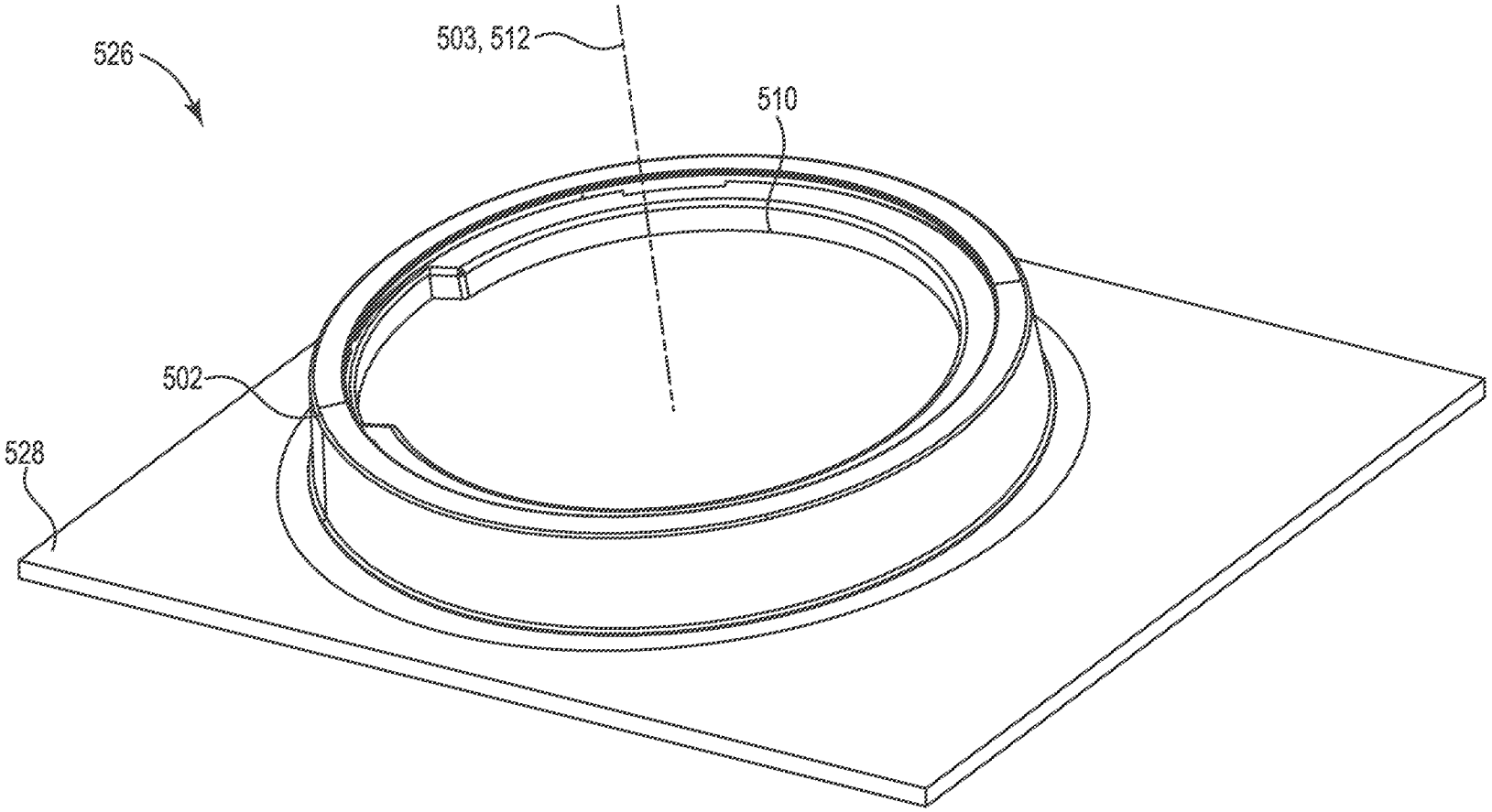
FIG. 5 is a perspective view of an example of a printing device including a dial, a middle cover, and an outer cover consistent with the disclosure.

FIG. 5 is a perspective view of an example of a printing device 526 including a dial 502, a middle cover 510, and an outer cover 528 consistent with the disclosure. The dial 502 can include a central axis 503 and the middle cover 510 can include a central axis 512.

As illustrated in FIG. 5, the printing device 526 can include an outer cover 528 of the printing device 526. For example, the outer cover 528 can be a portion of a housing of the printing device 526, and can be located on, over, and/or around other components of the printing device 526 and/or the dial control panel.

The dial 502 can be interfaced with the middle cover 510. The dial 502 can include the central axis 503. As previously described in connection with FIGS. 1, 3, and 4A, the dial 502 can include an inner channel (e.g., not illustrated in FIG.

5) defined by a first surface (e.g., not illustrated in FIG. 5) and a second surface (e.g., not illustrated in FIG. 5).

The middle cover 510 can include the central axis 512 and be connected to the outer cover 528. For example, the middle cover 510 can be connected to the outer cover 528 such that when the dial 502 is rotated (e.g., about the central axis 503 of the dial 502), the middle cover 510 is stationary. That is, the dial 502 can be rotated about the middle cover 510.

Although not illustrated in FIG. 5, the middle cover 510 can include other portions of the dial control panel. For example, a display and/or other parts of the dial control panel may be connected to the middle cover 510, may make electrical connections through the middle cover 510, etc. Accordingly, the dial 502 can be rotated about the middle cover 510, display, and/or other parts of the dial control panel.

As previously described in connection with FIGS. 1, 2A, 2B, 4A, and 4B, the middle cover 510 can include a first spring member and a second spring member. The first spring member can include a first lateral protrusion to interface with the first surface of the dial 502 and a vertical protrusion to interface with the second surface of the dial 502. The second spring member can include a second lateral protrusion to interface with the second surface of the dial 502. When the dial 502 is not interfaced with the middle cover 510, the first spring member and the second spring member can be biased away from the central axis 512 of the middle cover 510 (e.g., as previously described in connection with FIGS. 2A, 4A, and 4B.

When the dial 502 is interfaced with the middle cover 510 as illustrated in FIG. 5, the first spring member and the second spring member are to interface with the first surface and the second surface of the dial 502. As illustrated in FIG. 5, the dial 502 can be coaxially interfaced with the middle cover 510.

Because the first lateral protrusion, the second lateral protrusion, and the vertical protrusion (e.g., of the first and second spring members) interface with the first surface and second surface of the dial 502, the first lateral protrusion and the second lateral protrusion can provide a constant force against the first surface and the vertical protrusion can provide a constant force against the second surface.

As such, when the dial 502 is rotated relative to the middle cover 510, the constant force against the first surface can be a friction force to prevent horizontal jitter and/or free rotation of the dial 502. As used herein, the term "horizontal jitter" refers to lateral movement during rotation of an object. For example, the constant force against the first surface (e.g., by the first lateral protrusion of the first spring member and the second lateral protrusion of the second spring member) can provide friction force when the dial 502 is rotated by a user such that the dial 502 resists horizontal jitter. Further, the dial 502 does not freely spin as a result of the friction force.

Additionally, when the dial 502 is rotated relative to the middle cover 510, the constant force against the second surface can be a friction force to prevent vertical jitter and/or free rotation of the dial 502. As used herein, the term "vertical jitter" refers to vertical movement during rotation of an object. For example, the constant force against the second surface (e.g., by vertical protrusion of the first spring member) can provide friction force when the dial 502 is rotated by a user such that the dial 502 resists vertical jitter. Further, the dial 502 does not freely spin as a result of the friction force.

As a result, spring members according to the disclosure can provide a friction force against a dial such that when the dial is rotated (e.g., by a user), the dial does not produce any jitter (horizontal or vertical) and does not spin freely. Additionally, the friction provided against the dial rotation can provide for a smooth, quality rotation when the dial is rotated, providing a solid and connected feel. Further, molding the spring members as part of the middle cover can reduce manufacturing costs as less parts are utilized. Accordingly, such an approach can provide a positive user experience and result in a desirable product for consumers, as compared with previous approaches.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure. Further, as used herein, "a" can refer to one such thing or more than one such thing.

The figures herein follow a numbering convention in which the first digit corresponds to the drawing figure number and the remaining digits identify an element or component in the drawing. For example, reference numeral 106 may refer to element 110 in FIG. 1 and an analogous element may be identified by reference numeral 210 in FIG. 2A. Elements shown in the various figures herein can be added, exchanged, and/or eliminated to provide additional examples of the disclosure. In addition, the proportion and the relative scale of the elements provided in the figures are intended to illustrate the examples of the disclosure, and should not be taken in a limiting sense.

It can be understood that when an element is referred to as being "on," "connected to", "coupled to", or "coupled with" another element, it can be directly on, connected, or coupled with the other element or intervening elements may be present. In contrast, when an object is "directly coupled to" or "directly coupled with" another element it is understood that are no intervening elements (adhesives, screws, other elements) etc.

The above specification, examples and data provide a description of the method and applications, and use of the system and method of the disclosure. Since many examples can be made without departing from the spirit and scope of the system and method of the disclosure, this specification merely sets forth some of the many possible example configurations and implementations.

What is claimed is:

1. An apparatus, comprising:

a dial having a central axis and an inner channel defined by a first surface and a second surface; and a middle cover having a central axis, wherein:

the middle cover includes a first spring member having a first lateral protrusion to interface with the first surface and a vertical protrusion to interface with the second surface and a second spring member having a second lateral protrusion to interface with the first surface; and the first spring member and the second spring member are biased away from the central axis;

wherein when the dial is interfaced with the middle cover:

the first spring member and the second spring member are to interface with the first surface and the second surface of the dial; and the first lateral protrusion and the second lateral protrusion are to provide a constant force against the first surface and the vertical protrusion is to provide a constant force against the second surface.

2. The apparatus of claim 1, wherein when the dial is interfaced with the middle cover, the first surface is to cause the first spring member and the second spring member to rotate towards the central axis of the middle cover such that the first lateral protrusion and the second lateral protrusion provide a constant force against the first surface.

3. The apparatus of claim 2, wherein in response to the dial being rotated relative to the middle cover, the constant force against the first surface is a friction force to prevent horizontal jitter and free rotation of the dial.

4. The apparatus of claim 1, wherein the dial is coaxially interfaced with the middle cover.

5. An apparatus, comprising:

a dial having a central axis and an inner channel defined by a first surface and a second surface; and a middle cover having a central axis, wherein:

the middle cover includes a first spring member having a first lateral protrusion to interface with the first surface and a vertical protrusion to interface with the second surface and a second spring member having a second lateral protrusion to interface with the first surface; and the first spring member and the second spring member are biased away from the central axis of the middle cover;

wherein when the dial is interfaced with the middle cover:

the first spring member and the second spring member are to interface with the first surface and the second surface of the dial; and the first lateral protrusion and the second lateral protrusion are to provide a constant force against the first surface and the vertical protrusion is to provide a constant force against the second surface.

6. The apparatus of claim 5, wherein the second surface is perpendicular to the first surface.

7. The apparatus of claim 5, wherein in response to the dial being rotated relative to the middle cover, the constant force against the second surface is a friction force to prevent vertical jitter of the dial.

8. The apparatus of claim 5, wherein the first surface is to cause the first spring member and the second spring member to rotate towards the central axis of the middle cover.

9. A printing device, comprising:

an outer cover;

a dial having a central axis and an inner channel defined by a first surface and a second surface; and a middle cover connected to the outer cover and having a central axis, wherein:

the middle cover includes a first spring member having a first lateral protrusion to interface with the first surface and a vertical protrusion to interface with the second surface and a second spring member having a second lateral protrusion to interface with the first surface; and the first spring member and the second spring member are biased away from the central axis of the middle cover;

wherein:

when the dial is interfaced with the middle cover, the first spring member and the second spring member are to interface with the first surface and the second surface of the dial; and in response to the dial being rotated, the first lateral protrusion and the second lateral protrusion are to provide a constant force against the first surface and the vertical protrusion is to provide a constant force against the second surface.

10. The printing device of claim 9, wherein the first spring member and the second spring member are a pair of spring members of a plurality of pairs of spring members of the middle cover.

11. The printing device of claim 9, wherein the plurality of pairs of spring members are radially spaced apart from the central axis of the middle cover.

12. The printing device of claim 9, wherein the first surface is a polished surface.

* * * * *